US007414642B2

(12) United States Patent
Abe et al.

(10) Patent No.: US 7,414,642 B2
(45) Date of Patent: Aug. 19, 2008

(54) HEAT TRANSFER PRINTER

(75) Inventors: Yoshibumi Abe, Fukushima-ken (JP); Yuki Oishi, Fukushima-ken (JP); Takahito Maruyama, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 407 days.

(21) Appl. No.: 11/042,792

(22) Filed: Jan. 25, 2005

(65) Prior Publication Data

US 2005/0195269 A1 Sep. 8, 2005

(30) Foreign Application Priority Data

Jan. 26, 2004 (JP) ..... 2004-017083
Jan. 26, 2004 (JP) ..... 2004-017084
Jan. 27, 2004 (JP) ..... 2004-018233
Jan. 27, 2004 (JP) ..... 2004-018234

(51) Int. Cl.
*B41J 2/315* (2006.01)

(52) U.S. Cl. ..... 347/221

(58) Field of Classification Search ..... 347/215–217, 347/218, 219, 220, 221, 202–203; 400/234, 400/236

See application file for complete search history.

(56) References Cited

U.S. PATENT DOCUMENTS 5,709,488 A * 1/1998 Imai et al. ..... 400/234
5,936,653 A * 8/1999 Yamaguchi et al. ..... 347/216

FOREIGN PATENT DOCUMENTS

| | | |
|---|---|---|
| EP | 0 135 693 | 4/1985 |
| EP | 1 557 275 A2 | 7/2005 |
| JP | 8-156361 | 6/1996 |
| JP | 10-129023 | 5/1998 |
| JP | 2000-79717 | 3/2000 |

OTHER PUBLICATIONS

Search Report for corresponding European Patent Application Serial No. 05250124.4-1251, dated Aug. 29, 2007.

* cited by examiner

*Primary Examiner*—K. Feggins
(74) *Attorney, Agent, or Firm*—Brinks Hofer Gilson & Lione

(57) ABSTRACT

A heat transfer printer includes a line thermal head having heat generating elements formed in a straight line at one end of a top surface of a substrate and a sealing member for covering and protecting at least a portion of the top surface of the substrate at the other end thereof opposite to the heat generating elements. A film wrinkle removing member is disposed in the vicinity of the heat generating elements of the line thermal head upstream in a direction that an ink film is carried. A voltage is selectively applied to the heat generating elements when the line thermal head abuts a platen with the ink film and a printing sheet sequentially overlapped from the line thermal head disposed therebetween.

12 Claims, 7 Drawing Sheets

HEAT TRANSFER PRINTER

This application claims the benefit of priority to Japanese Patent Application Nos. 2004-017083 and 2004-017084 filed on Jan. 26, 2004 and 2004-018233 and 2004-018234 filed on Jan. 27, 2004, all herein incorporated by reference.

BACKGROUND OF THE INVENTION

1. Field of the Invention

The present invention relates to a heat transfer printer in which a plurality of heat generating elements of a thermal head selectively generates heat for transferring ink from an ink film to a sheet, thereby performing desired printing, and more particularly, to a heat transfer printer equipped with a line thermal head comprising a plurality of the heat generating elements arranged in a straight line so as to oppose an entire area in a lateral direction within a printing boundary of a printing sheet.

2. Description of the Related Art

Generally, in a heat transfer printer which performs printing by using an ink film, a line thermal head in which a plurality of heat generating elements having heat generation resistors is arranged in a row on a substrate is used. According to printing information, power is selectively applied to the respective heat generating elements of the line thermal head to generate heat, so that ink on the ink film is melted or sublimated and is then transferred to a printing sheet, such as a regular printing sheet, an overhead projector (OHP) sheet, or a sheet exclusively for sublimation printing, thereby performing printing.

In a conventional thermal head used in such a heat transfer printer, a heat reserving layer is formed on the surface of a heat-radiating substrate, and a projection is formed in the vicinity of a leading end of the top surface of the heat reserving layer so as to project by a predetermined height. Further, a heat generation resistor is formed in a laminated manner on the top surface of the heat reserving layer formed with the projection, and a common electrode and an individual electrode for applying a voltage to the heat generation resistor are respectively formed in the portions of the heat generation resistor at a leading end and a base end of the substrate. Also, a plurality of dotted heat generating elements is formed in a straight line in a portion of the heat generation resistor interposed between the common electrode and the individual electrode.

Further, a chip for a driver IC (hereinafter, referred to as an IC chip) connected to the common electrode and the individual electrode is disposed at the base end of the substrate. Also, the IC chip is covered and protected with a sealing member made of a sealing resin material.

In such a conventional line thermal head, the substrate is mounted on a head mount to be disposed on a main body of the printer, and the head mount is rotated so that each of the heat generating elements can be abutted on a platen with the ink film and the printing sheet disposed therebetween (hereinafter, the middle of an abutting portion between each of the heat generating elements and the platen in the direction that the printing sheet is carried will be referred to as 'abutting position').

When printing is performed by a heat transfer printer employing such a line thermal head, the ink film and the printing sheet are carried in a state in which each of the heat generating elements abuts the platen with the ink film and the printing sheet disposed therebetween, and on the basis of printing information, the plurality of heat generating elements selectively generates heat to heat the ink film, so that the ink on the ink film is transferred to the printing sheet to print characters or images on the sheet (for example, Japanese Unexamined Patent Application Publication No. 10-129023).

Meanwhile, similar to other electrical appliances, such a heat transfer printer is also required to be miniaturized or reduced in cost. In order to meet such requirements, the following have been studied. That is, the dimension of the substrate of the line thermal head in a direction orthogonal to the direction that the heat generating elements are arranged is drastically reduced as compared to conventional thermal heads, thereby realizing the miniaturization of the above-mentioned heat transfer printer. Further the number of substrates of the line thermal head cut off from one mother board is increased to achieve the cost reduction.

In the case where the dimension of the substrate in the direction orthogonal to the direction that the heat generating elements are arranged is reduced, a sealing member for protecting the IC chip from the heat generating elements is disposed in the vicinity of the heat generating elements on the top surface of the substrate. Thus, in a heat transfer printer equipped with the line thermal head in which the dimension of the substrate is reduced in the direction orthogonal to the direction that the heat generating elements are arranged, it is necessary to configure the line thermal head in which the abutting angle of the line thermal head when the line thermal head abuts the platen, that is, the angle at which the line thermal head is formed with respect to a tangential line at an abutting position between the line thermal head and the platen is adjusted to be larger than that of the conventional line thermal head, and only the heat generating elements properly abut the platen.

However, when the abutting angle of the line thermal head with respect to the platen becomes large, the space defined between the platen and the substrate of the line thermal head also becomes large. Also, the carrying of an ink film fed to a printing position where the heat generating elements abut the platen easily becomes unstable in such a largely formed space, and the ink film provided for printing is apt to be loosened or wrinkled, which adversely affects printing. In particular, there is a problem in that the ink film may tend to be wrinkled in a printing environment of high temperature and high humidity.

SUMMARY OF THE INVENTION

The present invention has been made in view of the problems, and it is an object of the present invention to provide a printer capable of preventing an ink film provided from being wrinkled, to realize high-quality printing.

In order to achieve the above object, a heat transfer printer according to the present invention comprises a line thermal head having a plurality of heat generating elements formed in a straight line at one end of a top surface of a substrate and a sealing member for covering and protecting at least a portion of the top surface of the substrate at the other end thereof opposite to the heat generating elements; and a film wrinkle removing member disposed in the vicinity of the heat generating elements of the line thermal head upstream in a direction that an ink film is carried, and the film wrinkle removing member made of a sheet material having elasticity. A voltage is selectively applied to the heat generating elements in a state in which the line thermal head abuts a platen with the ink film and a printing sheet sequentially overlapped from the line thermal head disposed therebetween, thereby performing desired printing. The film wrinkle removing member has its leading end located in the vicinity of the heat generating elements, and the heat generating elements of the thermal head are abutted on the ink film in a state in which the heat generating elements abuts the platen with the ink film and the printing sheet disposed therebetween.

Further, in order to achieve the above object, in the heat transfer printer according to the present invention, the leading end of the film wrinkle removing member is formed to be bent in a direction away from the thermal head.

Further, in order to achieve the above object, in the heat transfer printer according to the present invention, the film wrinkle removing member has its base end fixed to a head mount on which the thermal head is mounted, and has its leading end supported to face a space defined between the thermal head and the platen.

Further, in order to achieve the above object, in the heat transfer printer according to the present invention, the film wrinkle removing member is made of a resinous film material.

Further, in order to achieve the above object, a heat transfer printer according to the present invention comprises a line thermal head having a plurality of heat generating elements formed in a straight line at one end of a top surface of a substrate and a sealing member for covering and protecting at least a portion of the top surface of the substrate at the other end thereof opposite to the heat generating elements. A voltage being selectively applied to the heat generating elements in a state in which the line thermal head abuts a platen with an ink film and a printing sheet sequentially overlapped from the line thermal head disposed therebetween, thereby performing desired printing. A film wrinkle removing member made of an electrostatic suction film having a high electrostatic property is disposed. The film wrinkle removing member has its leading end located in the vicinity of the heat generating elements upstream in a direction that the ink film is carried, the leading end being supported to bring the heat generating elements of the thermal head into surface contact with the ink film to suction the ink film in a state in which the heat generating elements abut the platen with the ink film and the printing sheet disposed therebetween.

Further, in order to achieve the above object, a heat transfer printer according to the present invention comprises a line thermal head having a plurality of heat generating elements formed in a straight line at one end of a top surface of a substrate and a sealing member for covering and protecting at least a portion of the top surface of the substrate at the other end thereof opposite to the heat generating elements. A voltage is selectively applied to the heat generating elements in a state in which the line thermal head abuts a platen with the ink film and a printing sheet sequentially overlapped from the line thermal head disposed therebetween, thereby performing desired printing. A film wrinkle removing member which is slidably movable with respect to the ink film which travels while the line thermal head moves down, is disposed in the vicinity of the heat generating elements of the line thermal head upstream in a direction that the ink film is carried.

Further, in order to achieve the above object, in the heat transfer printer according to the present invention, the film wrinkle removing member is a projecting member formed in a line parallel to a direction that the heat generating elements are arranged.

Further, in order to achieve the above object, in the heat transfer printer according to the present invention, the film wrinkle removing member is made of a resinous film sheet.

Further, in order to achieve the above object, in the heat transfer printer according to the present invention, the film wrinkle removing member is made of a resinous film material having elasticity.

Further, in order to achieve the above object, a heat transfer printer according to the present invention comprises a line thermal head having a plurality of heat generating elements formed in a straight line at one end of a top surface of a substrate and a sealing member for covering and protecting at least a portion of the top surface of the substrate at the other end thereof opposite to the heat generating elements. A voltage is selectively applied to the heat generating elements in a state in which the line thermal head abuts a platen with the ink film and a printing sheet sequentially overlapped from the line thermal head disposed therebetween, thereby performing desired printing. A first film wrinkle removing member which is slidably movable with respect to the ink film which travels while the line thermal head moves down, is disposed in the vicinity of the heat generating elements of the line thermal head upstream in a direction that the ink film is carried. A second film wrinkle removing member made of an electrostatic suction film having a high electrostatic property has its leading end located in the vicinity of the first film wrinkle removing member upstream in a direction that the ink film is carried. The leading end is supported to come into surface contact with the ink film to suction the ink film while the line thermal head moves down.

Further, in order to achieve the above object, in the heat transfer printer according to the present invention, the first film wrinkle removing member is a projecting member formed in a line parallel to a direction that the heat generating elements are arranged.

Further, in order to achieve the above object, in the heat transfer printer according to the present invention, the first film wrinkle removing member is made of a resinous film sheet having elasticity.

DETAILED DESCRIPTION OF THE PREFERRED EMBODIMENTS

Figure 1:
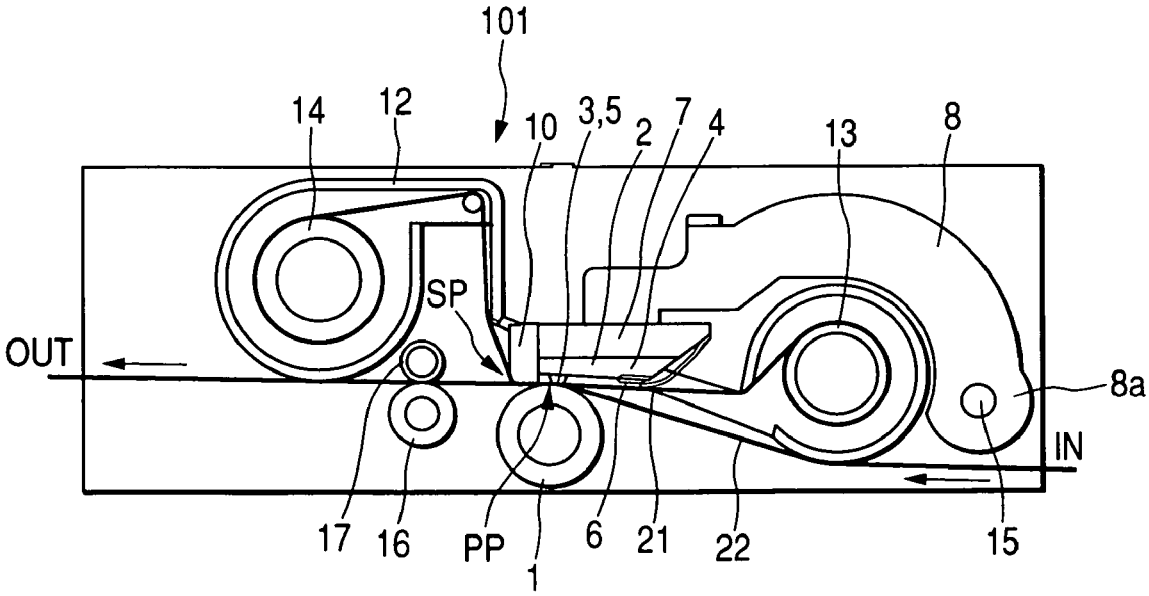
FIG. 1 is a schematic side view illustrating the construction of principal parts in a heat transfer printer of the present invention.
Figure 2:
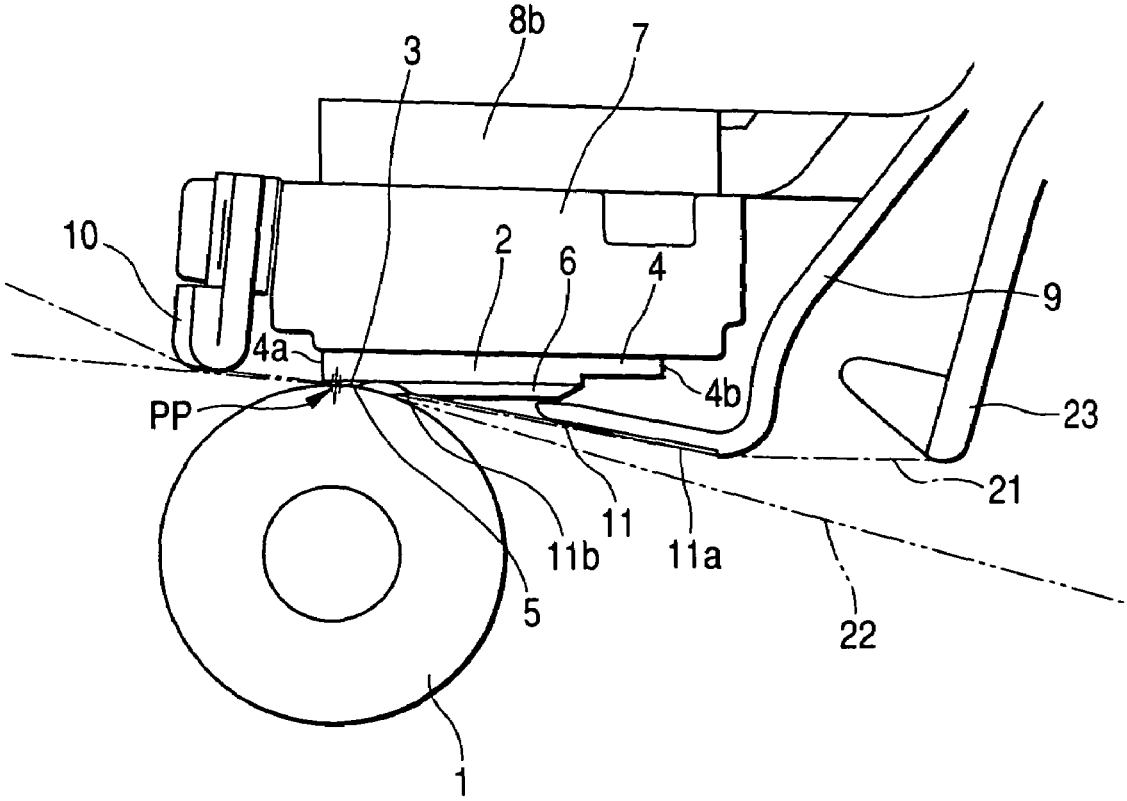
FIG. 2 is a schematic side view illustrating the construction of principal parts in a state in which a heat transfer printer according to a first embodiment of the present invention performs printing.
Figure 3:
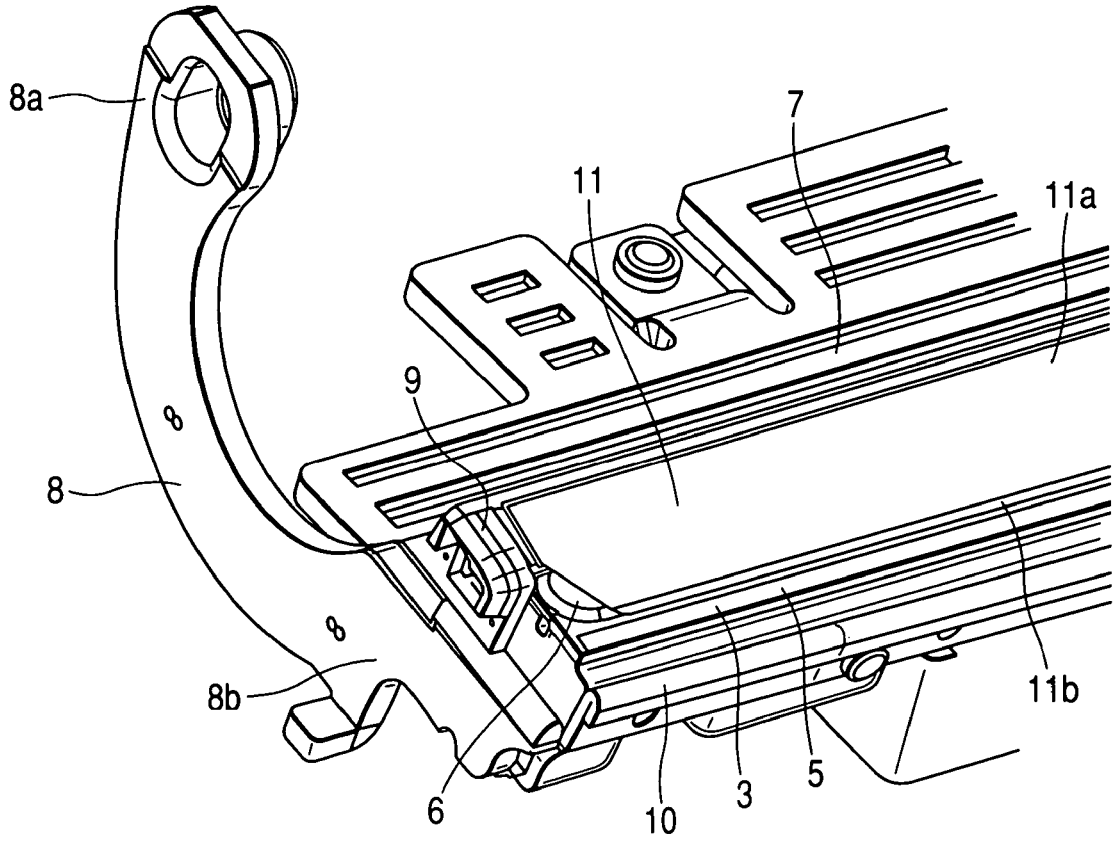
FIG. 3 is a perspective view of principal parts for explaining the positional relationship between a line thermal head and a film wrinkle removing member of the heat transfer printer according to the first embodiment of the present invention.

Preferred embodiments of the present invention will now be described with reference to the drawings. FIG. 1 is a side view illustrating the construction of principal parts of a heat transfer printer according to the present invention, FIG. 2 is a schematic side view illustrating the construction of principal parts in a state in which a heat transfer printer according to a first embodiment of the present invention performs printing, and FIG. 3 is a perspective view of principal parts for explaining the positional relationship between a line thermal head and a film wrinkle removing member of the heat transfer printer according to the first embodiment of the present invention.

As shown in FIG. 1, a platen roller 1 serving as a platen is rotatably disposed inside a main body of a heat transfer printer 101 of this embodiment. A line thermal head 2 serving as a printing head is arranged above the platen roller 1 such that heat generating elements 3 formed to be aligned with a printing surface are opposed to an outer peripheral surface of the platen roller 1 and extends in a direction parallel to an axial direction that is a longitudinal direction of the platen roller 1.

In the line thermal head 2, a heat reserving layer (not shown) made of glaze, etc. having a good heat retaining property is formed on a top surface of a substrate 4 having a good heat dissipating property, and a projection 5 is formed in a straight line in the vicinity of a leading end of the top surface of the heat reserving layer by partially projecting the surface by means of photolithography, etc. A plurality of the heat generating elements 3 including heat generating resistors made of Ta—N, Ta—$SiO_3$ or the like is linearly formed in a laminated manner on a top surface of the projection 5 of this heat reserving layer. A common electrode (not shown) and an individual electrode (not shown) for applying a voltage to each of the heat generating elements 3 are respectively laminated and patterned at a leading end 4*a* and a base end 4*b* of the substrate 4 of the heat generating elements 3 by sputtering of Al, Cu, Au, etc. or photolithography. During printing, the thermal head 2 is driven by a head driving mechanism (not shown) so as to abut the platen roller 1 with an ink film 21 and a printing sheet 22 disposed therebetween. Besides, the projection 5 is appropriately designed in a shape suitable for abutment on the platen roller 1 from the abutting angle, abutting position, etc. of the line thermal head 2 on the platen roller 1.

Further, a chip (hereinafter, referred to as an IC chip) for a driver IC (not shown) connected to the common electrode and the individual electrode is disposed on the substrate 4. The IC chip controls, for example, the voltage of a conduction pulse applied to the plurality of heat generating elements 3 so as to control the calorific power of the heat generating elements 3. Also, the IC chip is covered and protected with a sealing member 6 having its top surface made of a sealing resin for protection from external factors, such as mechanical or thermal stress and moisture. Besides, as forms of the IC chip and the sealing member 6, a chip-on-board (COB) may be adopted in which an IC chip is directly connected to the common electrode and the individual electrode on the substrate 4 and a mounting region is sealed with the sealing member 6, or a construction may be adopted in which an IC chip is packaged with the sealing member 6 and is then mounted on the line thermal head 2.

Further, a protective layer (not shown) made of hard ceramic, such as Si—O—N or SiAlON, having excellent oxidation resistance and wear resistance is coated on the top surfaces of the heat generating elements 3 by patterning or the like, the common electrode and the individual electrode with predetermined thickness for preventing oxidation and wear thereof.

Further, an external terminal (not shown), including an FPC (flexible printed circuit board) and the like, connected to a terminal of the IC chip is drawn out of the surface of the thermal head 2 at the other end 4*b* of the substrate 4.

Also, the line thermal head 2 is mounted on a head mount 7 made of a metallic material, such as a lightweight aluminum alloy, having an excellent heat dissipating property (heat conductivity) so that the heat accumulated in the heat reserving layer during printing is radiated through the substrate 4. Also, the head mount 7 is mounted on a leading end 8*b* of a head lever 8 whose base end 8*a* is pivotally supported by a supporting shaft 15. The head lever 8 is rotated about the supporting shaft by a driving force from a driving source (not shown) so that the line thermal head 2 mounted on the head mount 7 can selectively take either a head-down position where the line thermal head 2 abuts the platen roller 1 and a head-up position where the line thermal head 2 is separated from the platen roller 1.

As shown in FIGS. 1 and 2, the printing sheet 22 and the ink film 21 is fed to a space defined between the platen roller 1 and the line thermal head 2 in its head-down state sequentially from the platen roller 1 side. The abutting position between the platen roller 1 and the line thermal head 2 in its head-down state in which the line thermal head 2 abuts the platen roller 1 with a predetermined abutting force becomes a printing position PP where the ink on the ink film 21 is transferred to the printing sheet 22 provided for printing.

Further, an ink film guide 9 which forms a carrying path where the ink film 21 provided for printing does not come in contact with any portion other than the heat generating elements 3 is disposed upstream of the printing position PP in a direction that the ink film 21 on the head mount 7 is carried.

Moreover, in the printer of the present embodiment, a film wrinkle removing member 11 is further disposed on the head mount 7 for preventing the ink film 21 from being wrinkled. The film wrinkle removing member 11 is made of a sheet material having rigidity and elasticity and made of a resinous film material such as PET. The resinous film material can be said to be a proper material because it is low-cost, facilitates processing such as assembling or molding, and offers a wide selective choice of elasticity and rigidity thereof.

Besides, in the present embodiment, the film wrinkle removing member 11 is substantially in the form of a rectangle (in plan view) in which the length of an end side thereof is approximately equal to the line length of the heat generating elements 3. Also, one end side of the opposing end sides of the film wrinkle removing member 11 as a base end 11*a* of the film wrinkle removing member 11 is fixed to the ink film guide 9. The other end side opposite to the one end side as a leading end 11*b*, is faced to a space defined between the line thermal head 2 and the platen roller 1, to thereby cover the sealing member 6 exposed to the surface of the line thermal head 2, and is supported in a cantilever so as to be located in the vicinity of the heat generating elements 3 upstream in the direction that the ink film 21 is carried. Besides, FIG. 3 shows the film wrinkle removing member 11 in which a corner of the leading end 11*b* made of a resinous film material and having a substantially rectangular shape in plan view is chamfered.

Furthermore, a peeling member 10 for peeling the ink film 21 provided for printing off from the printing sheet 22 is formed downstream of the printing position PP in the direction that the ink film 21 on the head mount 7 is carried.

Further, the ink film 21 has a width corresponding to the printing width that is a lateral dimension of the sheet 22 in its printable range and can be carried along with the sheet 22. Also, during printing, the ink film 21 is fed out of a supply core 13 of an ink film cartridge 12, is guided by the ink film guide 9, and is fed to the printing position PP to be provided for printing in a state in which looseness of the ink film 21 or wrinkles thereof created by the looseness is/are removed by the film wrinkle removing member 11. Thereafter, the ink film 21 is sequentially wound around a winding core 14 which is located downstream.

Also, during printing, a voltage is selectively applied to the heat generating elements 3 on the base of printing information in a state in which the line thermal head 2 moves down, so that the heat generating elements 3 selectively generate Joule's heat. By the Joule's heat generated by the heat generating elements 3, the ink film 21 is partially heated so that the ink (not shown) on the ink film 21 can be transferred to the printing sheet 22 located on the platen roller 1 to record characters, images and the like.

Besides, the reference numeral 16 in FIG. 1 indicates a sheet feed roller which is rotatably driven by a motor (not shown). Also, the reference numeral 17 indicates a small roller which is disposed in such a manner to freely rotate. This roller is adapted to pinch the printing sheet in a state that abuts the sheet feed roller 16, to thereby carry the printing sheet with the rotation of the sheet feed roller 16.

As described above, the leading end of the film wrinkle removing member 11 is located in the vicinity of the heat generating elements 3 upstream in the direction that the ink film 21 is carried. Thus, in the vicinity the abutting position (i.e., printing position PP) where the heat generating elements of the line thermal head 2 abut the platen roller 1 with the ink film 21 and the printing sheet 22 disposed therebetween, the wrinkles of the ink film 21 can be spread to decrease a possibility that the ink film 21 may be again loosened or wrinkled between the leading end and the printing position PP. Further, the base end 11*a* of the film wrinkle removing member 11 is fixed to the head mount 7, and the leading end 11*b* thereof is supported in a cantilever so as to face the space defined between the line thermal head 2 and the platen roller 1, so that the elasticity of the film wrinkle removing member 11 can be more effectively utilized to push the wrinkles created in the ink film 21 back to the upstream in the direction that the ink film 21 is carried, which makes it possible to prevent the printing sheet 22 from being carried to the printing position PP.

In the present embodiment, the leading end 11*b* of the film wrinkle removing member 11 is formed to be bent in a direction away from the line thermal head 2, and is configured to abut the surface, opposing the line thermal head 2, of the ink film 21 which travels in a state in which the heat generating elements 3 of the line thermal head 2 abut the platen roller 1 with the ink film 21 and the printing sheet 22 disposed therebetween.

As such, the leading end 11*b* of the film wrinkle removing member 11 is formed to be bent in the direction away from the line thermal head 2, so that the elasticity of the film wrinkle removing member 11 can be more effectively utilized to return the wrinkles created in the ink film 21 to the upstream in the direction that the ink film 21 is carried.

Also, when the ink film 21 travels, the film wrinkle removing member 11 handles the ink film 21 by using its elasticity, to thereby push the looseness or wrinkles created in the ink film 21 back to upstream in the direction that the ink film 21 is carried. Thus, the wrinkles of the ink film 21 can be prevented from being supplied to the abutting position (printing position PP) that abuts the platen roller 1, which makes it possible to realize high-quality printing.

Further, the leading end 11*b* of the film wrinkle removing member 11 is located in the vicinity of (right before) the heat generating elements 3 upstream in the direction that the ink film 21 is carried, so that the wrinkles of the ink film 21 can be spread in the vicinity of the abutting position (printing position PP) where the heat generating elements of the line thermal head 2 abut the platen roller 1 with the ink film and the printing sheet disposed therebetween, to thereby decrease a possibility that the ink film 21 may be again loosened or wrinkled between the leading end and the printing position PP.

Next, a second embodiment of the present invention will now be described with reference to FIGS. 4 and 5.

Figure 4:
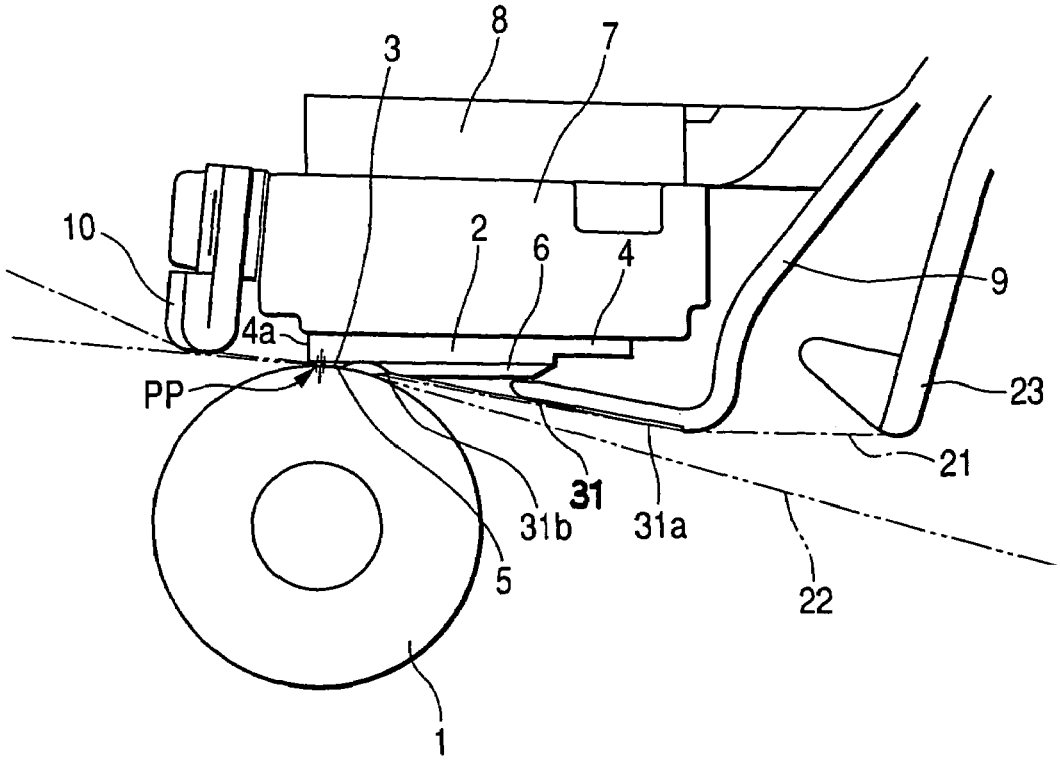
FIG. 4 is a schematic side view illustrating the construction of principal parts in a state in which a heat transfer printer according to a second embodiment of the present invention performs printing.
Figure 5:
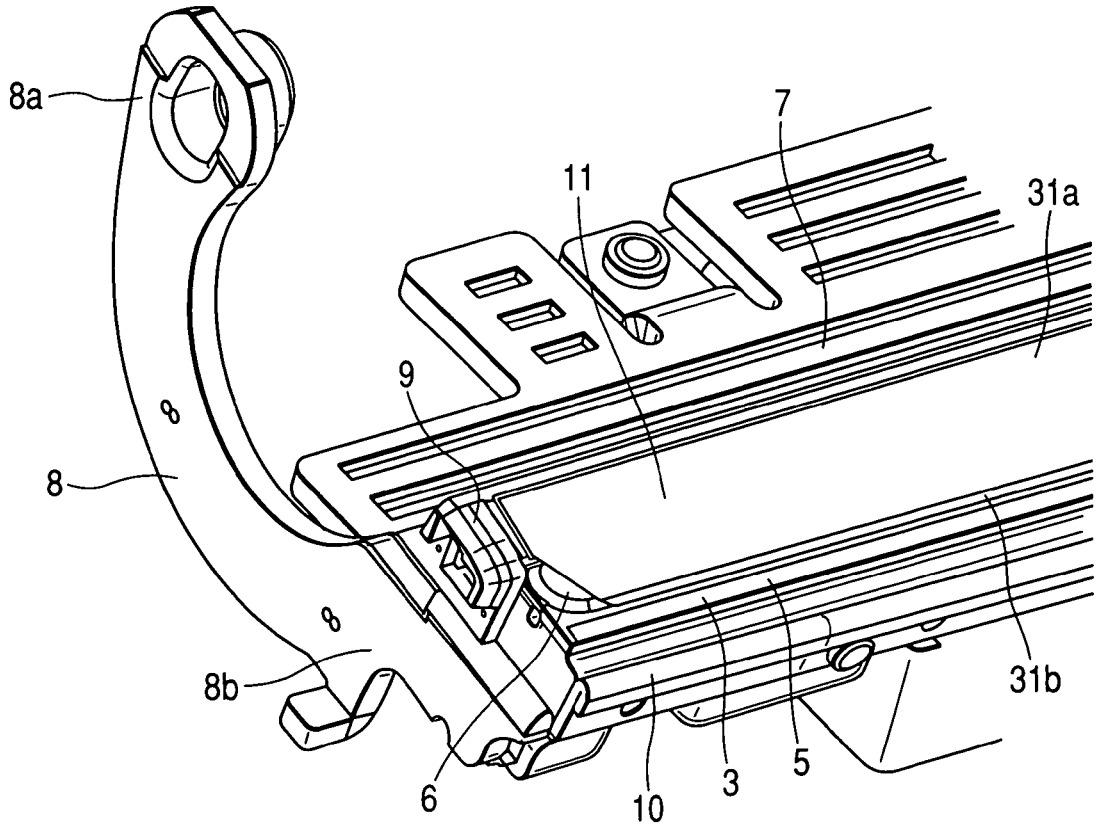
FIG. 5 is a perspective view of principal parts for explaining the positional relationship between a line thermal head and a film wrinkle removing member of the heat transfer printer according to the second embodiment of the present invention.

FIG. 4 is a side view illustrating the construction of principal parts in a state in which a heat transfer printer according to the second embodiment of the present invention performs printing, and FIG. 5 is a perspective view of principal parts for explaining the positional relationship between a line thermal head and a film wrinkle removing member of the heat transfer printer according to the second embodiment of the present invention.

In the second embodiment, the same reference numerals are given to the same parts as those of the above-mentioned first embodiment and thus the detailed description thereof will be omitted. A feature of the second embodiment different from that of the first embodiment, that is, only a film wrinkle removing member will be described in detail.

The film wrinkle removing member 31 in the present embodiment is made of a sheet material such as a resinous electrostatic suction film, such as poly vinyl chloride, having a high electrostatic property.

In the present embodiment, the film wrinkle removing member 31 is made of a sheet material having a low coefficient of surface friction to enhance a sliding property in a direction (widthwise direction) orthogonal to the direction that the ink film 21 is carried, so that the wrinkles created in the ink film 21 is more easily removed.

Moreover, in the present invention, the film wrinkle removing member 31 is substantially in the form of a rectangle (in plan view) in which the length of an end side thereof is approximately equal to the line length of the heat generating elements 3. Also, one end side of the opposing end sides of the film wrinkle removing member 31 as a base end 31*a* of the film wrinkle removing member 31 is fixed to the ink film guide 9. The other end side opposite to the one end side as a leading end 31*b* is faced to a space defined between the line thermal head 2 and the platen roller 1, to thereby cover the sealing member 6 exposed to the surface of the line thermal head 2, and is supported in a cantilever so as to be located right before the heat generating elements 3 upstream in the direction that the ink film 21 is carried. Besides, FIG. 5 shows the film wrinkle removing member 31 in which a corner of the leading end 31*b* of a resinous film material having a substantially rectangular shape in plan view is chamfered.

In a printer of the present embodiment constructed as above, the film wrinkle removing member 31 is brought into surface contact with the surface of the traveling ink film 21 opposing the line thermal head 2 in a state in which the heat generating elements 3 of the line thermal head 2 abut the platen roller 1 with the ink film 21 and the printing sheet 22 disposed therebetween, so that the ink film 21 can be sucked. Also, the traveling ink film 21 is smoothly sucked onto the surface of the film wrinkle removing member 31 opposing the platen roller 1 by using a suction force generated by the static electricity possessed by the film wrinkle removing member 31, thereby spreading the wrinkles created in the ink film 21.

Thus, the wrinkles of the ink film 21 can be prevented from reaching the printing position PP, which results in high-quality printing.

Further, the leading end of the film wrinkle removing member 31 is located in the vicinity of (right before) the heat generating elements 3 upstream in the direction that the ink film 21 is carried. Thus, in the vicinity of the abutting position (i.e., printing position PP) where the heat generating elements of the line thermal head 2 abut the platen roller 1 with the ink film 21 and the printing sheet 22 disposed therebetween, the wrinkles of the ink film 21 can be spread to decrease a possibility that the ink film 21 may be again loosened or wrinkled between the leading end and the printing position PP.

Next, a third embodiment of the present invention will now be described with reference to FIG. 6.

Figure 6:
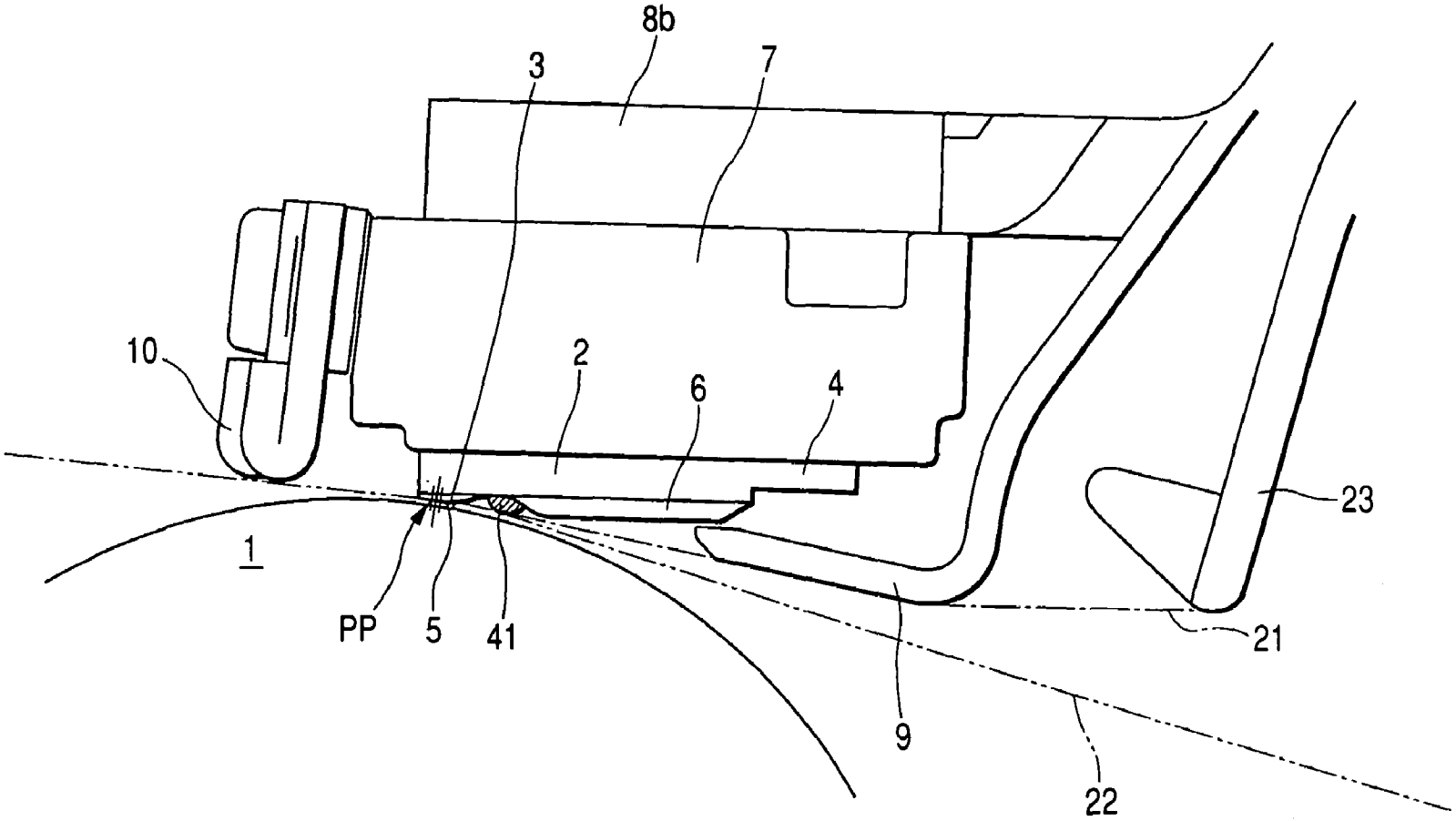
FIG. 6 is a schematic side view illustrating the construction of principal parts in a state in which a heat transfer printer according to a third embodiment of the present invention performs printing.

FIG. 6 is a side view illustrating the construction of principal parts in a state in which a heat transfer printer according to the third embodiment of the present invention performs printing.

In the third embodiment, the same reference numerals are given to the same parts as those of the above-mentioned first embodiment and thus the detailed description thereof will be omitted. A feature of the third embodiment different from that of the abovementioned first embodiment, that is, only a film wrinkle removing member will be described in detail.

In the present embodiment, the film wrinkle removing member 41 which comes in sliding contact with the traveling ink film 21 while the line thermal head moves down, is disposed in the vicinity of the heat generating elements upstream in the direction that the ink film 21 provided for printing of the line thermal head 2 is carried. The film wrinkle removing member 31 includes projecting members formed in a line parallel to the direction that the heat generating elements are arranged, as shown in FIG. 6, and made of an elastic substance such as low viscous rubber, sponge or Poron (trademark).

In this embodiment constructed as above, while the line thermal head 2 moves down, the film wrinkle removing member 41 is abutted on the surface of the ink film 21 traveling thereon opposing the line thermal head 2, and is brought into sliding contact therewith by the traveling of the ink film 21. At this time, the film wrinkle removing member 41 applies a tension to the ink film 21 to push the ink film 21 against the printing sheet 22, thereby spreading the wrinkles, and the wrinkles of the ink film 21 are pushed back to the upstream in the direction that the ink film is carried, so that the wrinkles can be prevented from reaching the abutting position (printing position) where the heat generating elements of the line thermal head 2 abut the platen roller 1 with the ink film 21 and the printing sheet 22 disposed therebetween.

Further, in the printer of the present embodiment, the film wrinkle removing member 41 formed in the line thermal head 2 is located in the vicinity of (right before) the heat generating elements 3 upstream in the direction that the ink film 21 is carried, so that the wrinkles of the ink film 21 can be spread in the vicinity of the abutting position (printing position PP) where the heat generating elements of the line thermal head 2 abut the platen roller 1 with the ink film and the printing sheet disposed therebetween, to decrease a possibility that the ink film 21 may be again loosened or wrinkled between the leading end and the printing position PP.

Further, since the film wrinkle removing member 41 in the present embodiment includes a projecting member formed in a line parallel to the direction that the heat generating elements are arranged, the wrinkles created in the ink film 21 can be surely removed in the direction that the heat generating elements are arranged, i.e., in the widthwise direction of the ink film 21.

Moreover, the film wrinkle removing member 41 in the present embodiment is made of an elastic substance, such as low viscous rubber, so that the ink film 21 can be pushed against the printing sheet 22 by a proper pressing force that does not obstruct the traveling of the printing sheet.

Next, a fourth embodiment of the present invention will now be described with reference to FIG. 7.

Figure 7:
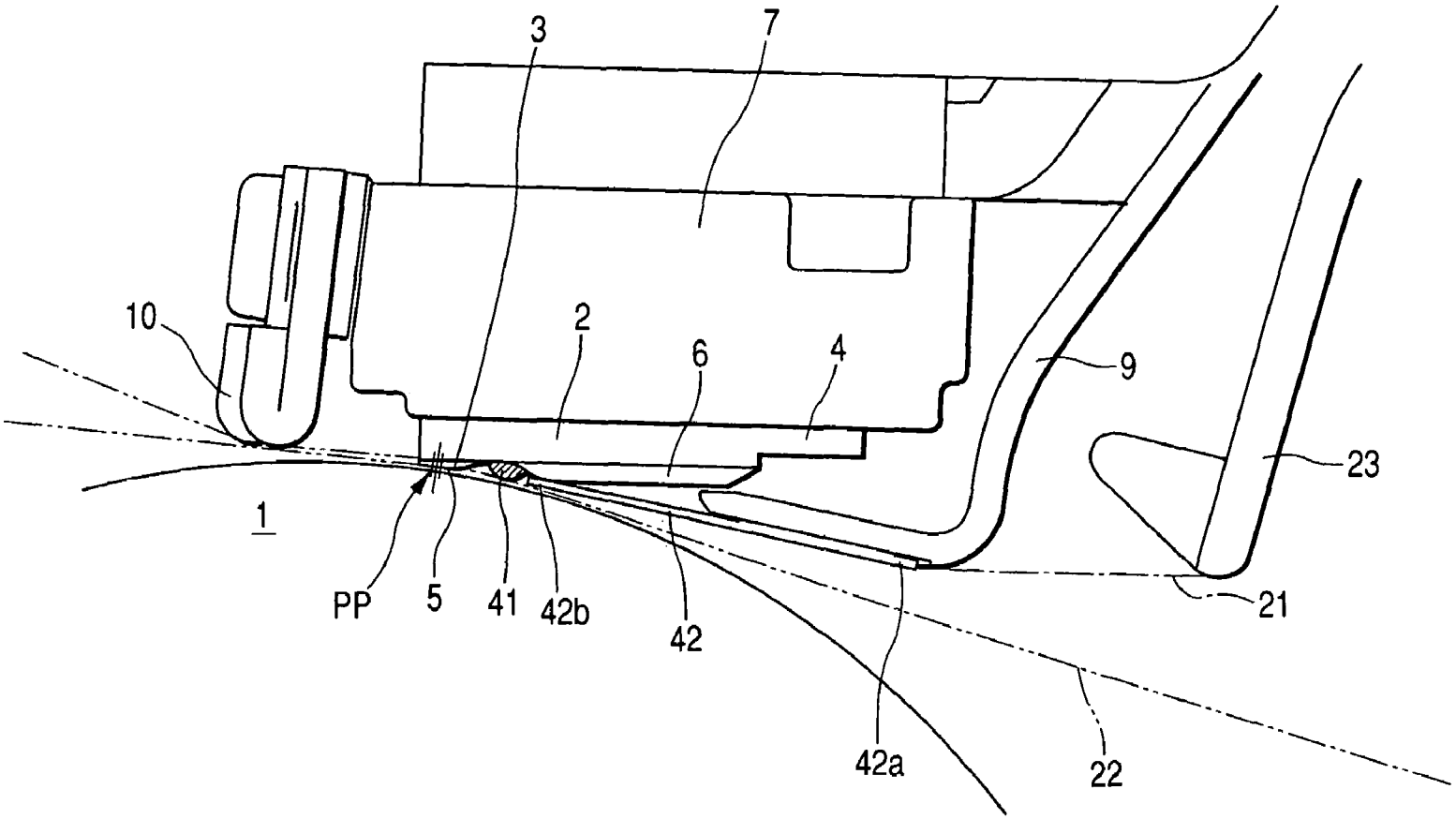
FIG. 7 is a schematic side view illustrating the construction of principal parts in a state in which a heat transfer printer according to a fourth embodiment of the present invention performs printing.

FIG. 7 is a side view illustrating the construction of principal parts in a state in which a heat transfer printer according to the fourth embodiment of the present invention performs printing.

In the fourth embodiment, the same reference numerals are given to the same parts as those of the above-mentioned first embodiment and thus the detailed description thereof will be omitted. A feature of the fourth embodiment different from that of the abovementioned first embodiment, that is, only a film wrinkle removing member will be described in detail.

In the present embodiment, the first film wrinkle removing member 41 which comes in sliding contact with the traveling ink film 21 while the line thermal head moves down, is disposed in the vicinity of the heat generating elements upstream in the direction that the ink film 21 provided for printing of the line thermal head 2 is carried. The first film wrinkle removing member 41 includes a projecting member formed in a line parallel to the direction that the heat generating elements are arranged, as shown in FIG. 7, and made of an elastic substance such as low viscous rubber, sponge or Poron.

Also, a second film wrinkle removing member 42 is further disposed in the ink film guide 9 for preventing the ink film 21 from being wrinkled.

The second film wrinkle removing member 42 is made of a sheet material such as a resinous electrostatic suction film, such as poly vinyl chloride, having a high electrostatic property.

Besides, in the present embodiment, the second film wrinkle removing member 42 is made of a sheet material having a low coefficient of surface friction to enhance a sliding property in a direction (widthwise direction) orthogonal to the direction that the ink film 21 is carried, so that the wrinkles created in the ink film 21 is more easily removed. Moreover, in the present embodiment, the second film wrinkle removing member 42 is substantially in the form of a rectangle (in plan view) in which the length of an end side thereof is approximately equal to the line length of the heat generating elements 3. Also, one end side of the opposing end sides of the second film wrinkle removing member 42 as a base end 42*a* of the second film wrinkle removing member 42 is fixed to the ink film guide 9. The other end side opposite to the one end side as a leading end 42*b* is faced to a space defined between the line thermal head 2 and the platen roller 1, to thereby cover the sealing member 6 exposed to the surface of the line thermal head 2, and is supported in a cantilever so as to be located immediately in front of the first film-wrinkle removing member 41 upstream in the direction that the ink film 21 is carried.

In the present embodiment constructed as above, when the line thermal head 2 moves down, the second film wrinkle removing member 42 is brought into surface contact with the surface of the traveling ink film 21 opposing the line thermal head 2, so that the ink film 21 can be sucked. Then, the traveling ink film 21 is smoothly sucked onto the surface of the second film wrinkle removing member 42 opposing the platen roller 1 by using a suction force generated by the static electricity possessed by the second film wrinkle removing member 42, thereby spreading the wrinkles created in the ink film 21. As a result, the wrinkles of the ink film 21 can be spread and removed.

In the present embodiment, while the line thermal head 2 moves down, the first film wrinkle removing member 41 formed in the line thermal head 2 right before of the heat generating elements upstream of the direction that the ink film is carried is abutted on the surface of the traveling ink film 21 opposing the line thermal head 2, and is brought into sliding contact therewith by the traveling of the ink film 21. At this time, the first film wrinkle removing member 41 applies a tension to the ink film 21 to push the ink film 21 against the printing sheet 22, thereby spreading the wrinkles, and the wrinkles of the ink film 21 are pushed back to the upstream in the direction that the ink film is carried, so that the wrinkles can be prevented from reaching the abutting position (printing position) where the heat generating elements of the line thermal head 2 abut the platen roller 1 with the ink film 21 and the printing sheet 22 disposed therebetween.

Further, in a printer of the present embodiment, the first film wrinkle removing member 41 formed in the line thermal head 2 is located in the vicinity of (right before) the heat generating elements 3 upstream in the direction that the ink film 21 is carried, so that the wrinkles of the ink film 21 can be spread in the vicinity of the abutting position (printing position PP) where the heat generating elements of the line thermal head 2 abut the platen roller 1 with the ink film and the printing sheet disposed therebetween. Thus, a possibility can be decreased that the ink film 21 may be again loosened or wrinkled between the leading end and the printing position PP.

Further, since the first film wrinkle removing member 41 in the present embodiment includes a projecting member formed in a line parallel to the direction that the heat generating elements are arranged, the wrinkles created in the ink film 21 can be surely removed in the direction that the heat generating elements are arranged, i.e., in the widthwise direction of the ink film 21.

Moreover, the first film wrinkle removing member 41 in the present embodiment is made of an elastic substance, such as low viscous rubber, so that the ink film 21 can be pushed against the printing sheet 22 by a proper pressing force that does not obstruct the traveling of the printing sheet.

What is claimed is:

1. A heat transfer printer comprising:

a line thermal head having a plurality of heat generating elements formed in a straight line at one end of a top surface of a substrate, and a sealing member for covering and protecting at least a portion of the top surface of the substrate at the other end thereof opposite the heat generating elements;

a film wrinkle removing member disposed in the vicinity of the heat generating elements upstream in a direction that an ink film is carried, the film wrinkle removing member made of an elastic sheet material;

a voltage being selectively applied to the heat generating elements in a state in which the line thermal head abuts a platen, with the ink film and a printing sheet sequentially overlapped from the line thermal head disposed therebetween, thereby performing desired printing;

the film wrinkle removing member having a leading end located in the vicinity of the heat generating elements, and supported in a cantilever manner such that wrinkles in the ink film are smoothed and pushed upstream and away from the heat generating elements; and wherein the heat generating elements abut the ink film in a state in which the heat generating elements abut the platen with the ink film and the printing sheet disposed therebetween.

2. The heat transfer printer according to claim 1, wherein the leading end of the film wrinkle removing member is formed to be bent in a direction away from the thermal head.

3. The heat transfer printer according to claim 2, wherein the film wrinkle removing member is made of a resinous film material.

4. The heat transfer printer according to claim 1, wherein the film wrinkle removing member has a base end fixed to a head mount on which the thermal head is mounted, and has a leading end supported to face a space defined between the thermal head and the platen.

5. The heat transfer printer according to claim 4, wherein the film wrinkle removing member is made of a resinous film material.

6. A heat transfer printer comprising:

a line thermal head having a plurality of heat generating elements formed in a straight line at one end of a top surface of a substrate and a sealing member for covering and protecting at least a portion of the top surface of the substrate at the other end thereof opposite to the heat generating elements;

a voltage being selectively applied to the heat generating elements in a state in which the line thermal head abuts a platen with an ink film and a printing sheet sequentially overlapped from the line thermal head disposed therebetween, thereby performing desired printing; and a film wrinkle removing member made of an electrostatic suction film having a high electrostatic property, wherein the film wrinkle removing member has a leading end located in the vicinity of the heat generating elements upstream in a direction that the ink film is carried, the leading end being supported to bring the heat generating elements of the thermal head into surface contact with the ink film to suction the ink film in a state in which the heat generating elements abut the platen with the ink film and the printing sheet disposed therebetween.

7. A heat transfer printer comprising:

a line thermal head having a plurality of heat generating elements formed in a straight line at one end of a top surface of a substrate, and a sealing member for covering and protecting at least a portion of the top surface of the substrate at the other end thereof opposite to the heat generating elements, a voltage being selectively applied to the heat generating elements in a state in which the line thermal head abuts a platen, with an ink film and a printing sheet sequentially overlapped from the line thermal head disposed therebetween, thereby performing desired printing; and a film wrinkle removing member slidably movable relative to the ink film which travels while the line thermal head moves down, the film wrinkle removing member disposed in the vicinity of the heat generating elements upstream in a direction that the ink film is carried, and supported in a cantilever manner such that wrinkles in the ink film are smoothed and pushed upstream and away from the heat generating elements.

8. The heat transfer printer according to claim 7, wherein the film wrinkle removing member is a projecting member formed in a line parallel to a direction that the heat generating elements are arranged.

9. The heat transfer printer according to claim 7, wherein the film wrinkle removing member is made of a resinous film sheet having elasticity.

10. A heat transfer printer comprising:

a line thermal head having a plurality of heat generating elements formed in a straight line at one end of a top surface of a substrate and a sealing member for covering and protecting at least a portion of the top surface of the substrate at the other end thereof opposite to the heat generating elements, a voltage being selectively applied to the heat generating elements in a state in which the line thermal head abuts a platen with an ink film and a printing sheet sequentially overlapped from the line thermal head disposed therebetween, thereby performing desired printing, wherein a first film wrinkle removing member which is slidably movable with respect to the ink film which travels while the line thermal head moves down, is disposed in the vicinity of the heat generating elements of the line thermal head upstream in a direction that the ink film is carried, and wherein a second film wrinkle removing member made of an electrostatic suction film having a high electrostatic property has a leading end located in the vicinity of the first film wrinkle removing member upstream in a direction that the ink film is carried, the leading end being supported to come into surface contact with the ink film to suction the ink film while the line thermal head moves down.

11. The heat transfer printer according to claim 10, wherein the first film wrinkle removing member is a projecting member formed in a line parallel to a direction that the heat generating elements are arranged.

12. The heat transfer printer according to claim 10, wherein the first film wrinkle removing member is made of a resinous film sheet having elasticity.

* * * * *